United States Patent [19]

Cobelli

[11] 4,279,601

[45] Jul. 21, 1981

[54] ARCHERY TRAINER AND EXERCISE DEVICE

[76] Inventor: Gabriel Cobelli, 84 Townline Rd., Nanuet, N.Y. 10954

[21] Appl. No.: 113,529

[22] Filed: Jan. 21, 1980

[51] Int. Cl.[3] ..... A63B 21/02

[52] U.S. Cl. ..... 434/247; 272/137

[58] Field of Search ..... 35/29 R; 124/17, 20, 124/22, 23 R; 272/93, 142, 143, 137

[56] References Cited

U.S. PATENT DOCUMENTS

| | | | |
|---|---|---|---|
| 2,496,140 | 1/1950 | Virenburg | 124/22 |
| 2,600,524 | 6/1952 | Fernsel | 124/20 R |
| 2,667,863 | 2/1954 | Styles | 124/20 R |
| 3,270,734 | 9/1966 | Clements | 124/20 |
| 3,521,362 | 7/1970 | Duplechin | 124/23 R X |
| 3,762,222 | 10/1973 | Garot | 124/23 R X |
| 4,125,106 | 11/1978 | Kelly | 124/17 |

FOREIGN PATENT DOCUMENTS

| | | | |
|---|---|---|---|
| 1185595 | 2/1959 | France | 124/22 |

*Primary Examiner*—Harland S. Skogquist
*Attorney, Agent, or Firm*—Amster, Rothstein & Engelberg

[57] ABSTRACT

An archery trainer and exercise device includes a gripping handle, an elastic cord connected to the gripping handle and a sighting rod extending from the gripping handle to permit a student archer to learn proper bow hand position and sighting while strengthening the particular muscles required for archery without the necessity for using an actual bow.

1 Claim, 4 Drawing Figures

FIG. 1
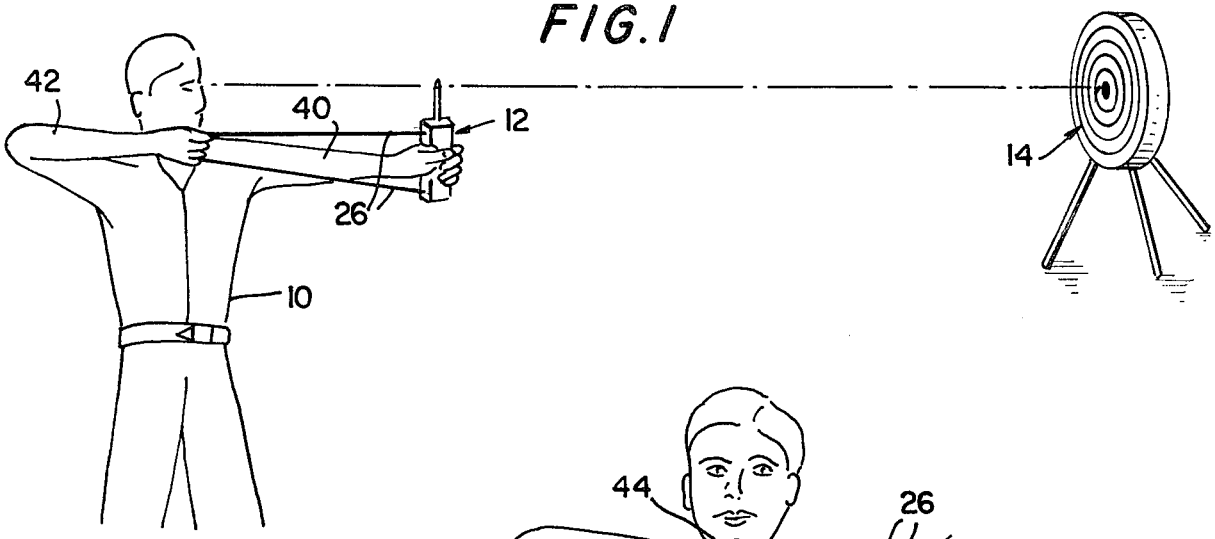
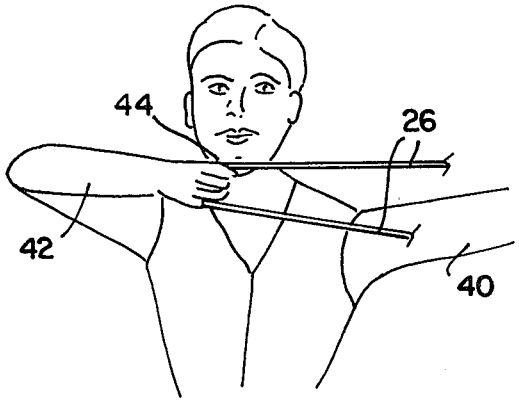
FIG. 2
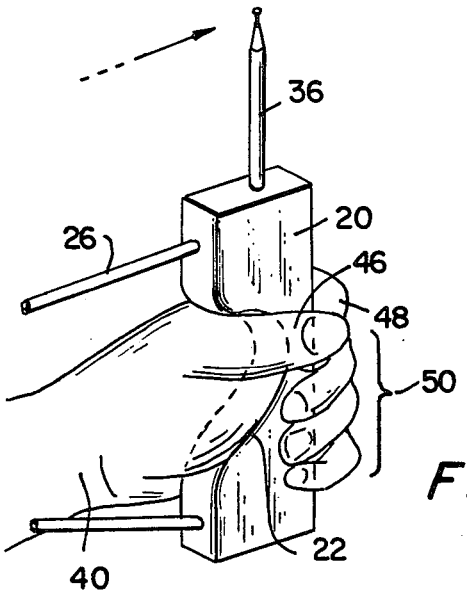
FIG. 3
FIG. 4
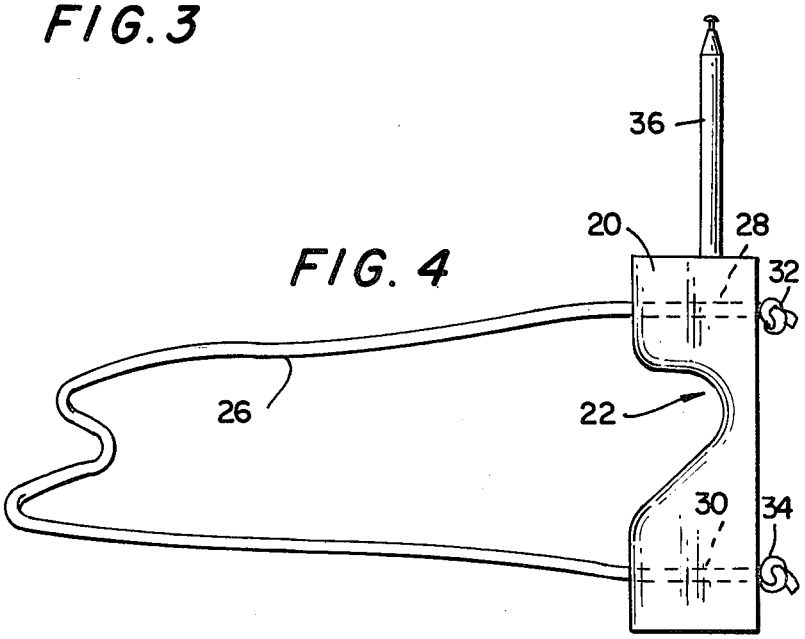

ARCHERY TRAINER AND EXERCISE DEVICE

This invention relates to an improved archery trainer and exercise device and in particular, is related to a device in which a student of archery can train to improve the sighting and handling of a bow and in strengthening the muscles necessary for improved archery performance.

In the past, to train an archery student required that the student actually use a bow in order to learn the proper grip, hand position and sighting. This training usually took place at an archery range. Students had a further problem in that the particular muscles required to shoot the bow were often not developed to the point to provide sufficient strength to pull back the bow string and hold it steady during sighting as required for accurate performance. The student's progress in learning these skills was therefore slowed by the student's lack of strength in the particular muscles required for archery.

In accordance with this invention, there is provided a combined archery trainer and exercise device which has the objects of improving the student's ability to properly aim at a target and strengthening the muscles required for proper and accurate archery.

By use of this invention, a student learns and practices all the phases of modern archery which requires diligence and constant practice to establish good archery form. The student also performs the exercise necessary to develop and strengthen the back shoulder muscles without which the bow cannot be held steady on the target. The archer is thus able to shoot without strain and is relaxed in order to get a good score.

It is a particular object of the invention to provide an archery trainer in which the student learns the proper position for accurate shooting without requiring that the student have sufficient strength to pull back an actual bow string.

It is a further object of the invention to provide an exercise which will strengthen the muscles of the archery student which are particularly used for archery.

In one embodiment of the invention, there is provided a gripping handle having a curve therein for receiving the hand of the archer to simulate the portion of the bow gripped by the archer. A force resistant means such as an elastic cord is joined to the gripping handle at points above and below the curve therein to simulate the bow string. Sighting means such as a rod extends upwardly from the gripping handle to provide a sight.

In operation, the elastic cord is grasped with a hook formed by the first bend of the first three fingers of the right hand and the curve in the handle is gripped by the other hand. The tips of the fingers draw the elastic cord to the chin so that the hollow formed by the base of the index finger and the thumb fits snugly over and under the chin as a solid fixed anchor. The thumb rests on the little finger to help support the solid anchor. It is important that this anchor be placed on the chin in the same place every time and it is one feature of this invention that the student archer can do repeatedly. The correct position of the bow arm is assumed with the left hand held lightly over the curved part of the of the handle, held shoulder high and the point of the elbow at the seven o'clock position. To check the correct position of the bow arm and the point of the elbow at seven o'clock position, the bow arm is extended fully and then the arm is bent at the elbow. If the hand touches the chest, the position is correct. If the hand touches the head the position is wrong. Holding the bow arm correctly will avoid the slapping of the fleshy part of the bow arm with the bow string which is painful. After the correct position has been set, the sighting rod is aimed at a real or imaginary target with both eyes open. With the sighting rod steady, the archer opens the hook and brings the fingers straight back with a smooth motion brushing the chin and ear in a smooth follow through.

By utilizing the archery trainer the student learns the proper bow hand position necessary for accurate shooting. The archer also learns how to draw a bow back properly such that the archer's back muscles can be set in a correct and most efficient manner. Furthermore, the archer is able to get the feeling of the archery position while sighting over the sighting rod and is able to learn to hold that position steady for an extended period of time necessary to properly sight on and hit a target. Furthermore, the archer learns the steps in shooting from the position of the hand on the bow to the draw of the bow string, the aim, the hold, the release and follow through. All of these steps are easily learned without the strain accompanying the shooting of an actual bow. Drawing the elastic cord back strengthens the back and shoulder muscles which are required for proper and accurate shooting and the device can be used as an exerciser for that purpose.

These and other objects and features of the invention will become clear to those skilled in the art from consideration of the following detailed description of a preferred embodiment of the invention when taken in conjunction with the accompanying drawings, wherein:

FIG. 1 is a representation of an archer utilizing the archery trainer and exercise device of the invention to learn proper hand position and sighting;

FIG. 2 is a closeup and enlarged representation of the archer of FIG. 1 utilizing the archery trainer and exercise device of the present invention and particularly showing the position of the fingers relative to the head of the archer;

FIG. 3 is a closeup and enlarged representation of the gripping handle of the invention showing an archer gripping the handle; and FIG. 4 is a side elevation view of the archery trainer and exercise device of the present invention showing the gripping handle elastic loop and sighting rod.

Referring to FIG. 1, there is shown a student archer 10 holding the archery trainer and exercise device 12 in the proper position for sighting at a distant target 14.

As shown in more detail in FIG. 4, archery trainer and exercise device 12 includes a gripping handle 20 having a gripping curve 22 formed therein for receiving the hand of the archer to simulate the portion of the bow gripped by the archer. A force resistance device, such as elastic cord 26 is joined to gripping handle 22 at points above and below gripping curve 22 to simulate a bow string. In the embodiment of the invention shown in FIG. 4, gripping handle 22 is provided with holes 28, 30 which pass through gripping handle 22. Elastic cord 26 is secured to gripping handle 22 by passing the opposite ends of elastic cord 26 through holes 28 and 30 and forming knots 32, 34 at the opposite side of gripping handle 22 to prevent elastic cord 26 from being pulled through holes 28, 30 as elastic cord 26 is drawn back during the use of archery trainer and exercise device 12. Archery trainer and exercise device 12 also includes a sight such as sighting rod 36 which extends upwardly from the upper surface of gripping handle 22 and provides a point along which the student archer can sight toward a target.

Referring back to FIG. 1, the use of the device is illustrated. Elastic cord 26 is grasped, as illustrated, by the right hand 42 and the left hand 40 grasps the gripping curve 22 in gripping handle 20. Elastic cord 26 is drawn back to the chin 44 (see FIG. 2) so that the hollow formed by the base of the index finger and thumb fit snugly over and under the chin and provide a solid fit anchor. The thumb rests on the little finger to help support this solid anchor. As shown in FIG. 3, gripping handle 20 is held by placing gripping curve 22 in the "V" formed between the thumb 46 and second finger 48 of left hand 42 and wrapping the remaining three fingers 50 around the outside of gripping handle 20. As shown in FIG. 1, the left hand 42 is raised and gripping handle 20 is held shoulder high. The student sights along the tip of sighting rod 36 to the center of distant target 14. Of course, if an actual target is not available, a simulated target would be used. The student must now keep sighting rod 36 steady. When steady on the target, the student opens the hook formed by the fingers of the right hand and brings the fingers now striaght back in a smooth motion brushing the chin and ear in a smooth follow-through. Elastic loop 26 springs forward simulating the action of a bow string.

To do the exercise, the elastic cord 26 is drawn back and the shoulders are forced way back so that the shoulder blades almost touch each other. This position is held for a few seconds. Then relax and take the tension off the elastic cord by bringing the right arm forward but still holding on to the cord. Now shoulders back so that the shoulder blades almost touch each other and hold for a few seconds. Then bring the right arm forward as before and continue for 5 minutes. This exercise should be done every day. To strengthen the elastic cord it can be shortened. It may be necessary to wear a glove on the right hand to protect the fingers.

By repeating these exercises, the student archer obtains the feeling for and proper position of the arms and sighting and obtains training in maintaining steady sight on target, all of which are essential when shooting a bow and arrow. Furthermore, the archery trainer and exercise device also strenghtens the back and shoulder muscles required for pulling the bow string back and releasing it for the proper archery technique.

What has been described is a single presently preferred embodiment of the invention. It will be readily apparent to those skilled in the art that various changes and modifications can be made which still remain within the spirit and scope of the invention as set forth in the appended claims.

What I claim is:

1. An archery trainer and exercise device comprising a gripping handle having an upper and lower surface with a gripping curve having an upper and lower end formed therein between the upper and lower surface for holding the archery trainer and exercise device during use, said gripping handle having a first upper hole formed therethrough located between the upper surface and the upper end of said gripping curve and extending horizontally from the front to the rear of said gripping handle and a second lower hole formed therethrough located between the lower surface and the lower end of said gripping curve and extending horizontally from the front to the rear of said gripping handle, a continuous elastic cord having a first end passing through the upper hole in said gripping handle and secured forward of said gripping handle and a second end passing through said lower hole in said gripping handle and secured forward of said gripping handle to prevent the elastic cord from being pulled through the holes when in use, and a sighting rod mounted on the upper surface of the gripping handle and extending vertically upward therefrom to permit a student archer to grip the gripping handle at the gripping curve between the horizontally extending first and second holes in the gripping handle while orienting the gripping handle with the upper hole vertically above the lower hole and pull the elastic cord rearward in a generally horizontal direction toward the user while sighting over the vertically upwardly extending sighting rod toward a real or imaginery target, whereby the student archer can simulate the use of a bow to learn proper bow hand position and sighting to the target while simultaneously strengthening the muscles required for accurate shooting.

* * * * *